US005163265A

United States Patent [19]

Darcy et al.

[11] Patent Number: 5,163,265

[45] Date of Patent: Nov. 17, 1992

[54] APPARATUS FOR WRAPPING A FLEXIBLE MEMBER

[75] Inventors: John J. Darcy, Webster; Boris Haritonoff, Geneseo; Edouard E. Langlois, Rochester; Karl V. Thomsen, Ontario, all of N.Y.

[73] Assignee: Xerox Corporation, Stamford, Conn.

[21] Appl. No.: 724,265

[22] Filed: Jul. 1, 1991

[51] Int. Cl.[5] ..... B65B 63/04; B65B 25/14

[52] U.S. Cl. ..... 53/118; 53/581; 53/593

[58] Field of Search ..... 53/116, 118, 581, 593, 53/119, 139.5, 415, 430, 587, 211, 214

[56] References Cited

U.S. PATENT DOCUMENTS

| | | | |
|---|---|---|---|
| 2,732,063 | 1/1956 | Dedek et al. | 53/593 |
| 2,962,847 | 12/1960 | Thoele | 53/118 |
| 3,501,889 | 3/1970 | Grulich et al. | 53/116 |
| 3,694,998 | 10/1972 | Brinkley et al. | 53/593 X |
| 3,942,637 | 3/1976 | Glennie | 206/389 |
| 3,984,241 | 10/1976 | Schrempp et al. | 96/1 R |
| 4,056,918 | 11/1977 | Matsumoto | 53/118 |
| 4,162,009 | 7/1979 | Schouten | 206/389 |
| 4,219,272 | 8/1980 | Brückel et al. | 355/16 |
| 4,416,532 | 11/1983 | Rosati | 355/3 BE |
| 4,707,704 | 11/1987 | Allen et al. | 346/24 |
| 4,903,908 | 2/1990 | Hänsch | 53/118 X |
| 4,912,510 | 3/1990 | Ogura et al. | 355/212 |
| 4,926,216 | 5/1990 | Hashimoto et al. | 355/212 |

FOREIGN PATENT DOCUMENTS

| | | | |
|---|---|---|---|
| 279016 | 11/1989 | Japan | 53/593 |

*Primary Examiner*—John Sipos
*Assistant Examiner*—Linda B. Johnson
*Attorney, Agent, or Firm*—Gary B. Cohen

[57] ABSTRACT

An apparatus is provided for wrapping a sheet about an external surface of a flexible member to package the flexible member. The apparatus comprises a mechanism for receiving and clamping a free end of the sheet and a first portion of the flexible member, as well as a mechanism for spacing a second portion of the flexible member a preselected distance from the first portion thereof. The apparatus further comprises a mechanism for moving the receiving and clamping mechanism to urge the spacing mechanism toward the receiving and clamping mechanism so that movement of the receiving and clamping mechanism wraps the flexible member and sheet with the sheet being wrapped about the external surface of the flexible member.

20 Claims, 11 Drawing Sheets

APPARATUS FOR WRAPPING A FLEXIBLE MEMBER

BACKGROUND OF THE INVENTION

1. Field of the Invention

The present invention relates generally to a technique for wrapping a sheet about an external surface of a flexible member, and more specifically to an apparatus for entraining the flexible member and the sheet about support means so that the flexible member is wrapped about itself and the sheet serves to substantially prevent any point of the flexible member external surface from touching any other point of the flexible member external surface.

2. Description of the Prior Art

In the art of electrophotography an electrophotographic plate comprising a photoconductive insulating layer on a conductive layer is imaged by first uniformly electrostatically charging the imaging surface of the photoconductive insulating layer. The plate is then exposed to a pattern of activating electromagnetic radiation such as light, which selectively dissipates the charge in the illuminated areas of the photoconductive insulating layer while leaving behind an electrostatic latent image in the non-illuminated area. This electrostatic latent image may then be developed to form a visible image by depositing finely divided electroscopic toner particles on the surface of the photoconductive insulating layer. The resulting visible toner image can be transferred to a suitable receiving member such as paper. This imaging process may be repeated many times with reusable photoconductive insulating layers.

The electrophotographic plate may be in the form of a flexible photoreceptor belt. These flexible belts include a substrate and a sensitive layer, the sensitive layer including an electrically conductive surface and at least one photoconductive layer. A common flexible photoreceptor belt comprises a substrate, a conductive layer, an optional hole blocking layer, an optional adhesive layer, a charge generating layer, a charge transport layer and, in some embodiments, an anti-curl backing layer.

These photoreceptor belts are usually thin and flimsy. Any considerable amount of handling of the belt, through, for example, shipping, can result in damage to the sensitive layer. Scratches, dents and other forms of damage to the sensitive layer, resulting from handling, can lead to degradation in image quality in printed material produced by the printing machine. Additionally, handling of the belt is made more difficult when the belt is in an unraveled state.

A proposed approach for eliminating the above-discussed difficulties has been disclosed in U.S. Pat. No. 5,119,133 to Swain the relevant portions of which are incorporated by reference herein. In particular, a photoconductive belt covered by protective paper is extended about first and second cores. The second core is inserted in a C-shaped hollow core, the C-shaped core having a slot configured to prevent the escape of the second core therefrom. When the second core is disposed in the C-shaped core, the belt extends through the slot. In operation, the C-shaped core is rotated, so that the first core is drawn toward the C-shaped core. When the first core is proximate to the C-shaped core, the belt is fully entrained about the three cores, and the second core is nested in the C-shaped core. The first core and the C-shaped core are held together by a U-shaped clip.

Another proposed approach for eliminating the above-discussed difficulties is to manually entrain the belt and a sheet of protective paper about a plurality of cores or cardboard tubes in such a way that no point of the sensitive layer surface touches any other point of the sensitive layer surface. In one example, first, second and third cores are respectively positioned on first, second and third mandrels, and the cores are disposed adjacent one another. A gap is formed between the first and second cores, and a free edge of a sheet of protective paper and a portion of the belt is then clamped between the first and second cores. After straightening out the belt, by moving; the third core away from the second core, the first and second cores are rotated simultaneously about an axis disposed between the first and second cores. As the first and second cores are rotated simultaneously, the third core is drawn toward the second core until the protective paper and the belt are entrained completely about the cores in the above-described manner.

While these proposed approaches result in an adequately wrapped belt, manual entraining of the belt about the cores is undesirable. In particular, manual entraining is labor-intensive. Moreover, the proposed approaches do not minimize manufacturing costs. Regarding the first approach, manufacturing costs are increased by both the use of the customized C-shaped core and the need to adhere protective backing to the outer, sensitive surface of each belt. Regarding the second approach, cost is increased when more than one belt size must be wrapped since various sets of mandrels must be employed and various lengths of precut sheets of protective paper must be kept in stock. It would be desirable to provide a belt-wrapping apparatus that minimizes manufacturing costs substantially and eliminates the need to perform wrapping steps manually. Accordingly, all steps would be achieved automatically using both relatively cheap components and a single supply of protective paper capable of being cut into sheets of varying length.

The following references may be pertinent to the present application:

- U.S. Pat. No. 3,942,637; Patentee: Glennie; Issued: Mar. 9, 1976.
- U.S. Pat. No. 3,984,241; Patentee: Schrempp et al. Issued: Oct. 5, 1976.
- U.S. Pat. No. 4,162,009; Patentee: Schouten; Issued: Jul. 24, 1979.
- U.S. Pat. No. 4,219,272; Patentee: Brukel et al. Issued: Aug. 26, 1980.
- U.S. Pat. No. 4,416,532; Patentee: Rosati; Issued: Nov. 22, 1983.
- U.S. Pat. No. 4,707,704; Patentee: Allen et al. Issued: Nov. 17, 1987.
- U.S. Pat. No. 4,912,510; Patentee: Ogura et al. Issued: Mar. 27, 1990.
- U.S. Pat. No. 4,926,216; Patentee: Hashimoto et al. Issued: May 15, 1990.

U.S. Pat. No. 3,942,637 discloses a packaging configuration for endless nested abrasive belts, which configuration includes a first core having an axial slot to receive axially within the first core one end of a nest of belts. The belts are wound around the first core and a second core is disposed in the opposite end of the belts. A third core inserted in the nest of belts and disposed in the loop within the first core further restricts kinking of the belts.

U.S. Pat. No. 3,984,241 discloses an apparatus and method for continually replacing a photoconductor belt with incremental fresh segments from a cartridge.

U.S. Pat. No. 4,162,009 discloses a packaging configuration for an endless fabric material used in paper making machines, which configuration includes two inner cores at the extreme ends of the endless fabric. One end of the endless fabric is inserted into a third, larger core, the third core having a split and hinged construction. The remaining fabric is wound around the outside of the third core. The two inner cores may be mounted on stringing poles during winding to minimize deflection of the cores. If the cores are sufficiently rigid, they are inserted directly in chuck jaws. The ends of the assembled inner cores may be banded together to prevent unrolling and the banded assembly may be wrapped with a protective cover.

U.S. Pat. No. 4,219,272 discloses an electrophotographic copying apparatus comprising a replaceable photoconductive sheet having a leading edge portion and a trailing edge portion. The apparatus further includes a guide drum rotatably supported to a drum shaft, a holding device for securing the leading sheet edge to the guide drum and a pressing roller which guides and engages the sheet.

U.S. Pat. No. 4,416,532 discloses a free end of a cantilever-mounted photoconductor belt capstan rigidly secured to a machine frame by a pivotable mechanism including a slide pin and dog arrangement for cooperating with a receiving block on the machine frame. This mechanism is arranged to operate a tension applying-/relieving shoe against the inner surface of the photoconductor belt.

U.S. Pat. No. 4,707,704 discloses a paper material drive mechanism associated with a rotatable drum. The drum carries three rollers: an idler roller, a tension roller and a drive roller. The idler roller and the tension roller are each biased toward the drive roller to provide traction for the movement of the paper.

U.S. Pat. No. 4,912,510 discloses a photosensitive sheet located in a cartridge, which cartridge is located in an image forming apparatus. The cartridge is comprised of a box for containing a roll of unused photosensitive sheet and a shaft, the shaft being used to wrap up used portions of the photosensitive sheet. The shaft has adhesive sections so as to wrap the used photosensitive sheet securely.

U.S. Pat. No. 4,926,216 discloses a feeder of sheet-like photosensitive materials to a drum in an electrophotographic printer. In accordance with the invention, sheet-like photosensitive materials, each cut to a necessary length, are stuck to release paper and are then formed to assume a rolled configuration. The outer peripheral end of the previously rolled release paper is seized by a roll, and the sheet-like photosensitive material can be fed sheet by sheet to the drum by taking up the release paper while rotating the roll.

SUMMARY OF THE INVENTION

In accordance with the present invention, an improved apparatus is provided for wrapping a sheet about an external surface of a flexible member to package the flexible member. The apparatus comprises means for receiving and clamping a free end of the sheet and a first portion of the flexible member, as well as means for spacing a second portion of the flexible member a preselected distance from the first portion thereof. The apparatus further comprises means for moving the receiving and clamping means to urge the spacing means toward the receiving and clamping means so that movement of the receiving and clamping means wraps the flexible member and sheet with the sheet being wrapped about the external surface of the flexible member.

In one example of the present invention, the receiving and clamping means includes means for supporting the flexible member. The flexible member can be an elongate flexible loop, and the support means can comprise at least one finger adapted to both receive and position a core member, the core member being adapted to support internal portions of the elongate flexible loop. Additionally, the core member can define a hollow cavity and the transverse cross-sectional area of the finger can be substantially less than the transverse cross-sectional area of the hollow cavity.

In another example of the present invention the spacing means comprises means for urging the spacing means away from the receiving and clamping means after the first and second portions of the flexible member have been respectively positioned about the receiving and clamping means and said spacing means. The apparatus can further comprise means for selectively biasing the spacing means adjacent the receiving and clamping means.

In yet another example of the invention the sheet includes a main body and a tail portion. In this example, the apparatus includes means for folding the tail portion from an unwrapped position to a wrapped position so that the tail portion is disposed immediately adjacent the main body of the sheet. Additionally, the apparatus can comprise means for securing the tail portion to the main body.

Numerous features will be appreciated by those skilled in the art.

One feature of the present invention is that it minimizes labor costs. That is, employment of the apparatus allows for significant reduction in the number of manual steps to be performed. In the preferred form of operation, multiple tasks are performed automatically without the need for user interaction.

Another feature of the present invention is that it optimally facilitates the wrapping procedure. In particular, the belt is tightly and compactly wrapped about support means. Consequently, human error commonly resulting from repetitively wrapping belts is virtually eliminated. Moreover, the apparatus accomplishes the wrapping process with the highest degree of efficiency. For example, in one preferred form of operation, the protective paper feeding and wrapping steps can be performed by the apparatus in less than twenty seconds.

Another feature of the present invention is that it is extremely cost-effective. Cost savings are achieved as a result of the apparatus having the capability to cut the protective paper on an "as need" basis. Moreover, it is particularly economical that all sizes of belts can be wrapped with one set of fingers, the fingers being adjustable positionally for belts of varying length.

These and other aspects of the invention will become apparent from the following description, the description being used to illustrate a preferred embodiment of the invention when read in conjunction with the accompanying drawings.

DESCRIPTION OF A PREFERRED EMBODIMENT OF THE INVENTION

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Figure 1:
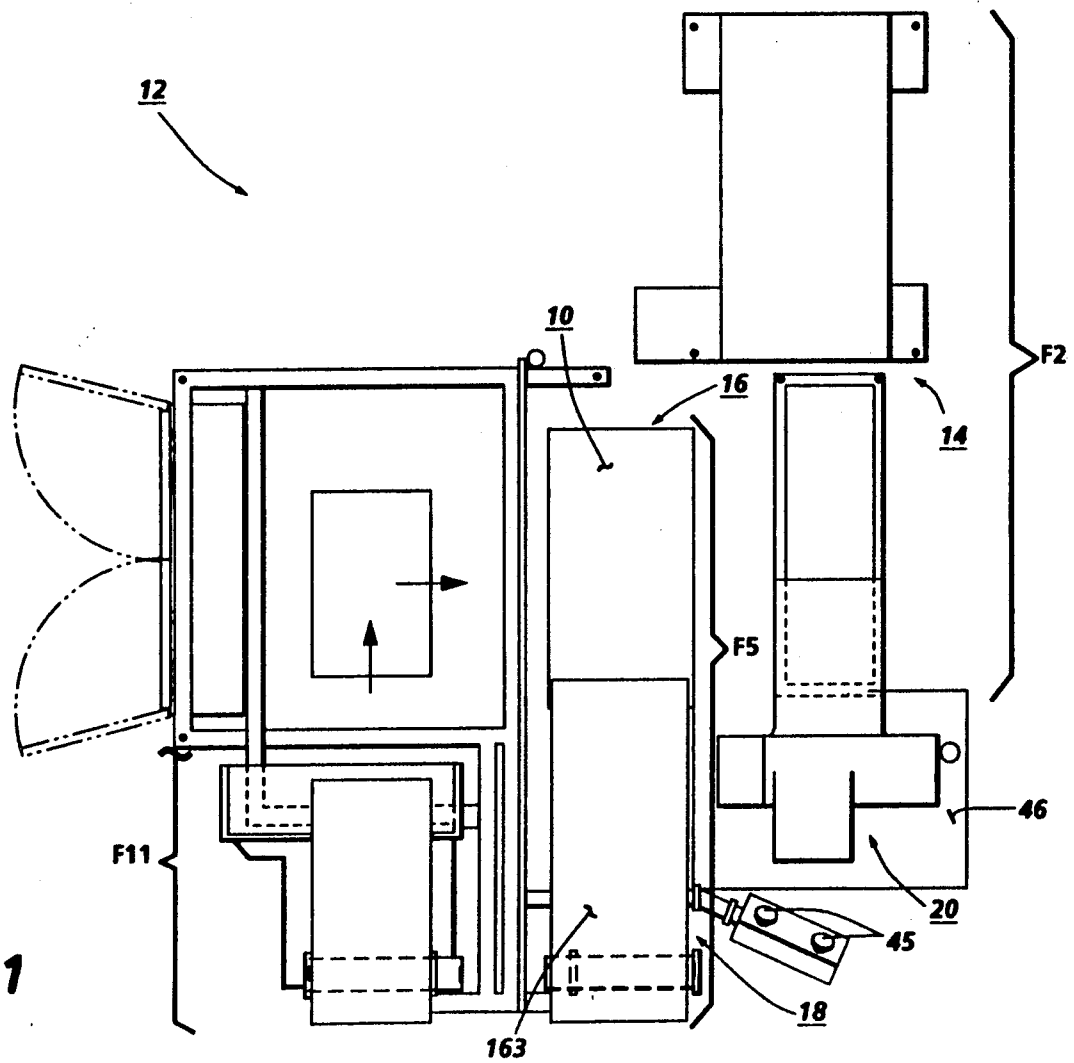
FIG. 1 is a schematic view of a floor plan of an apparatus for wrapping protective paper about a sensitive surface of a flexible image loop.

Referring to FIG. 1, a floor-plan of an apparatus for automatically wrapping protective paper about a flexible image loop 10 is designated by the numeral 12. In the illustrated embodiment, the flexible image loop is a photoreceptor belt having a length and a width. The apparatus 12 includes a core transport assembly 14, a wrapping assembly 16 and a protective protective paper feed assembly 18.

Figure 2:
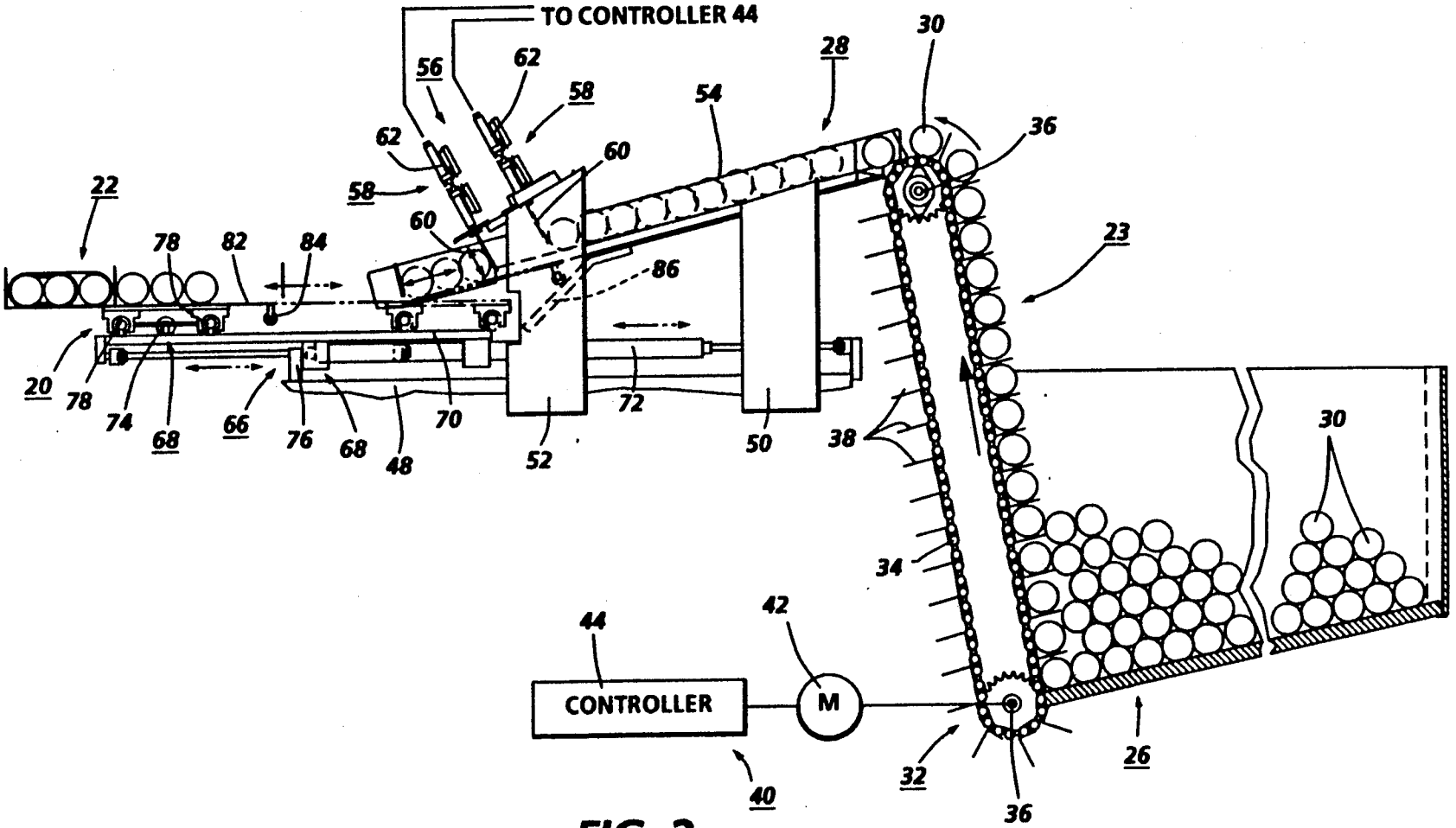
FIG. 2 is a schematic, elevational view of an assembly for both selectively loading cores onto a transport device and transporting the cores to a belt wrapping assembly.

Referring to FIG. 2, the core transport assembly 14 is illustrated in further detail. The transport assembly 14 includes a movable cart 20, the cart 20 having a receiving bin 22 mounted thereto and being in communication with a loading station 23. The loading station 23 includes a hopper 26 and a chute 28, the hopper 26 being adapted to store a plurality of cores or cardboard tubes 30. The cores 30 are transported to the chute 28 by way of a conveyor mechanism 32. The conveyor mechanism 32 comprises an endless chain 34 wrapped around sprockets 36, the chain 34 having spaced-apart paddle-wheels 38 affixed thereto. The sprockets 36 are driven by a conventional motor arrangement 40.

The motor of motor arrangement 40, as well as all motors referred to hereinafter, are controlled by way of a conventional drive mechanism 42 interfaced with a programmable controller or a microprocessor 44, such microprocessor 44 being obtainable from Motorola Corporation (via the 68000 series). As illustrated in FIG. 1, the controller 44 includes palm buttons 45 for starting and stopping the apparatus 12. Additionally, a safety mat 46, which serves as a "deadman's switch" for the apparatus 12 is positioned next to the palm buttons 45. When the operator is standing on the mat 46, the apparatus 12 is maintained in an inoperative state.

Figure 3:
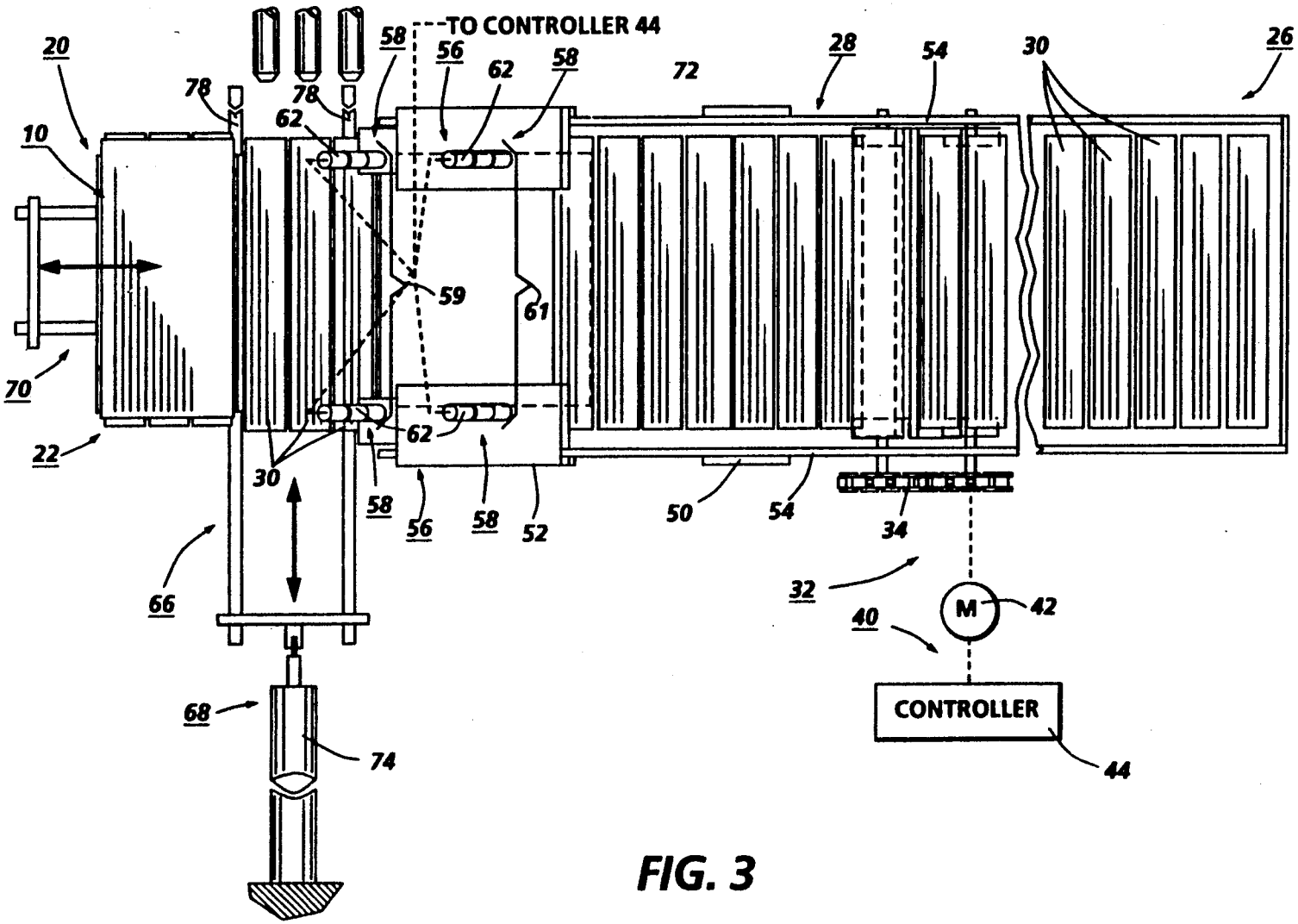
FIG. 3 is a schematic, overhead plan view of the assembly illustrated in FIG. 2.

As illustrated in FIGS. 2 and 3, the paddle-wheels 38 are capable of raising the cores 30 out of the hopper 26 to the chute 28. The chute 28 is supported by a frame 48 having supports 50, 52, while the chute 28 is inclined so that cores 30 can roll freely down to the cart 20. Referring specifically to FIG. 3, the chute 28 has ledges 54 for retaining the cores 30 therein, and the chute 28 is adjustable laterally to accommodate for cores 30 of varying lengths. As the cores 30 roll down the chute 28, they are selectively retained by a capturing mechanism 56. In one example, the capturing mechanism 56 comprises two pairs of submechanisms 58, each of which submechanism 58 is operatively mounted to the support 52. The front pair of submechanisms 58 will hereinafter be referred to as core stop 59, while the rear pair of submechanisms 58 will be referred to as core separator 61. Each submechanism 58 has a retractable needle 60 connected to an air cylinder 62. The spacing between the core stop 59 and the core separator 61 is such that a predetermined number of cores 30 can be retained between the needles 60 when the needles 60 are in the extended position. The needles 60 are extended and retracted by use of the air cylinders 62.

Figure 4:
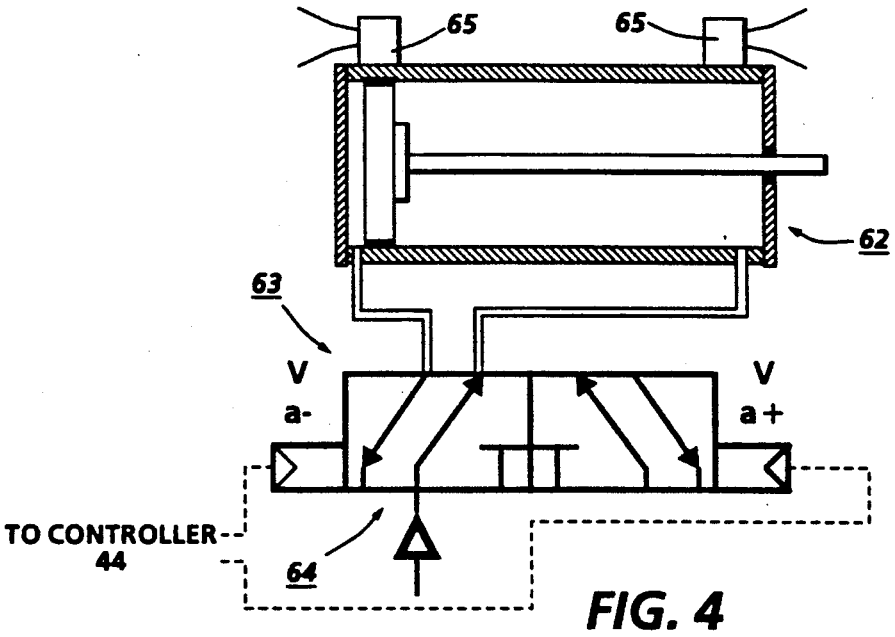
FIG. 4 is a schematic, sectional view of an arrangement used to drive a typical air cylinder used in the apparatus.

Referring specifically to FIG. 4, an arrangement employed to drive air cylinder 62, as well as most of the air cylinders used throughout the apparatus 12, is designated by the numeral 63. The arrangement 63 includes a supply of compressed air (not shown), a bidirectional valve 64 and the microprocessor 44. In the preferred embodiment, the valve 64, which can be obtained from Norgren Corporation, shifts air direction according to whether the valve 64 is positively or negatively biased by the microprocessor 44. Additionally, when the piston of cylinder 62 is magnetic, the extent of movement of the air cylinder 62 can be sensed by used of conventional limit switches 65.

The cart 20 is operatively associated with a shutting mechanism 66 (FIGS. 2 and 3), the shutting mechanism 66 including a drive mechanism 68 and a transport table 70. The drive mechanism 68 comprises a dual-position air cylinder 72 for driving the table 70 in a first direction, and a cylinder 74 for driving the cart 20 in a second direction, the second direction being transverse to the first direction. As best illustrated in FIG. 2, a dual position cylinder comprises two cylinders in series, both of which function cooperatively to position that cart 20 in two distinct positions, namely a core-loading position and an unloading position. The dual-position air cylinder 72 is operatively mounted to the frame 48, while the second cylinder 74 is interconnected with the table 70. In particular, the transport table 70 is supported by portions of the dual-position air cylinder 72, and the cart 20 is slideably mounted on the transport table 70 by way of a pair of guide rails 78 formed thereon. Accordingly, the cart 20 can be driven, along the second direction, from one end of the table to the other by use of the second cylinder 74.

In one example, a platform 82 (FIG. 2), having a raised edge, is positioned on the cart 20 adjacent the receiving bin 22. A cam follower 84 is mounted on the underside of the platform 82, the cam follower 84 being adapted to cooperate with a cam 86 mounted on the underside of the chute 28. As best illustrated in FIG. 2, when an edge of the cart is brought proximate to the support 52, the cam follower 84 rides along the cam 86 so that the platform 82 directly underlies the exit edge of the chute 28. As the cart 20 is moved away from the chute 28, the platform 82, having a preselected number of the cores 30 disposed thereon, pivots down onto the cart 20 so that the raised edge of the platform 82 abuts a raised edge of the receiving bin 22.

Figure 5:
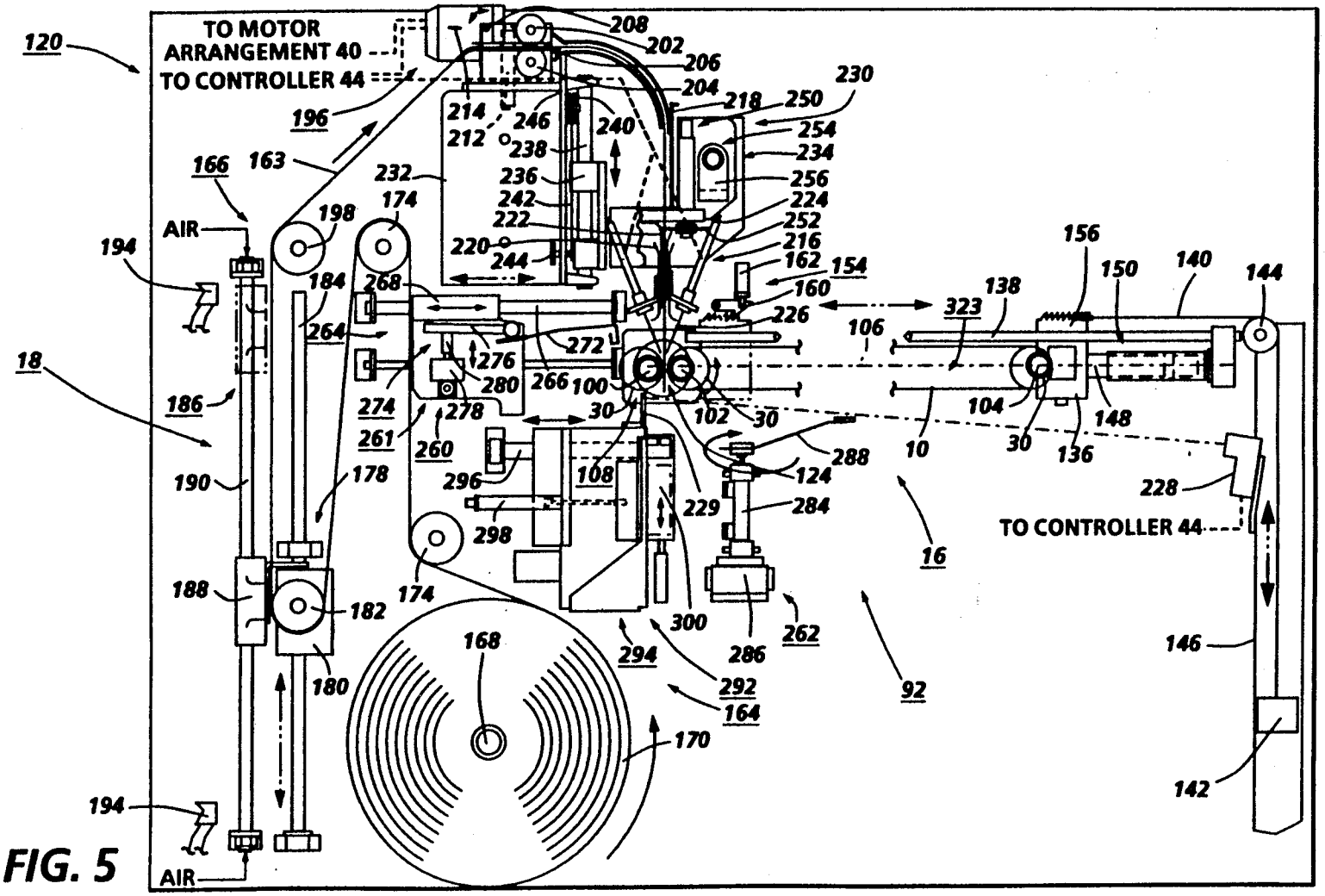
FIG. 5 is a schematic, elevational view of a protective paper feeding assembly coupled with the belt wrapping assembly.
Figure 6:
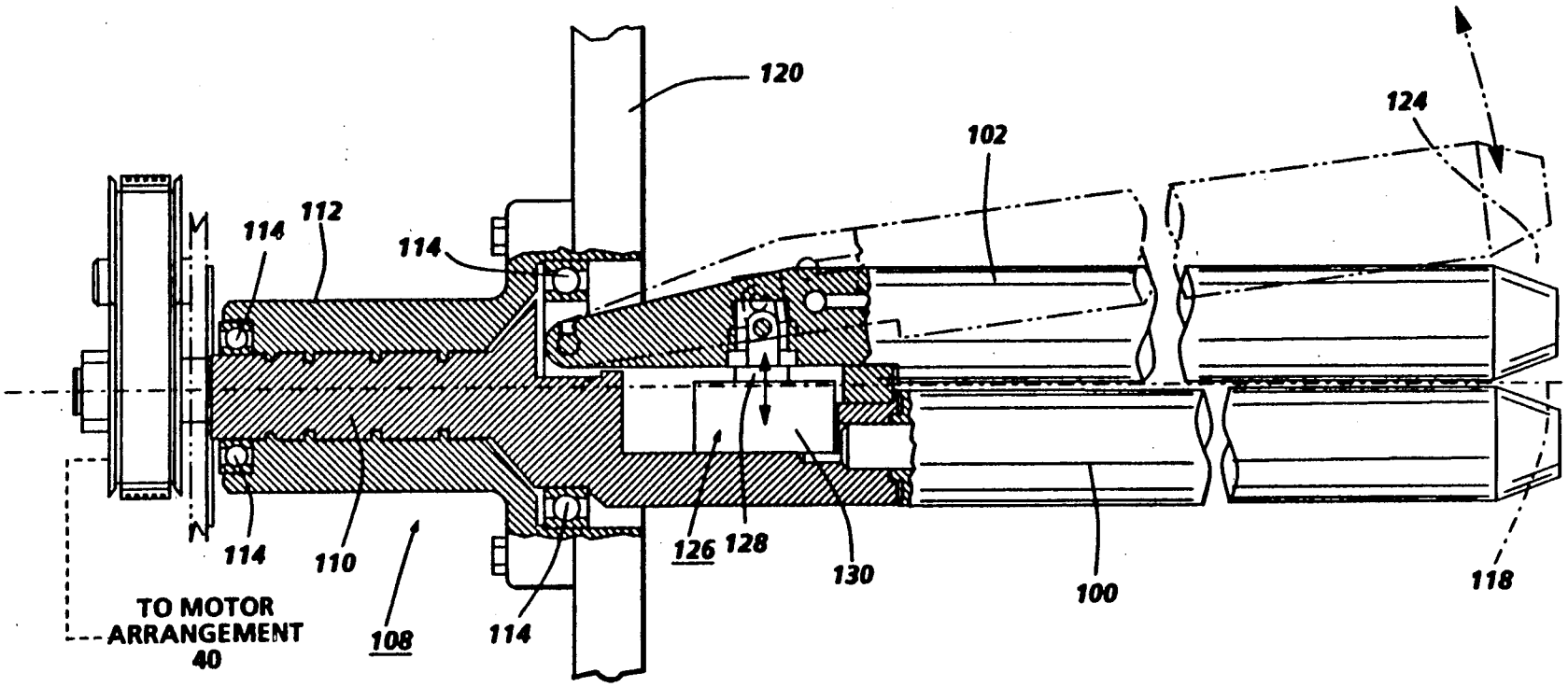
FIG. 6 is a schematic, elevational view of two fingers operatively mounted to a Turret.

Referring to FIGS. 3 and 5, three cores 30 are shuttled at a time to a wrapping station designated by the numeral 92. The wrapping station 92 comprises the wrapping assembly 16 and the protective paper feeding assembly 18. The wrapping assembly 16 includes a first finger 100, a second finger 102 and a third finger 104, each of which fingers 100, 102, and 104 is disposed along a common plane 106. Referring specifically to FIG. 6, the fingers 100, 102 are operatively mounted to a turret mechanism 108, the turret mechanism 108 including a shaft 110 rotatably mounted in a collar 112 with bearings 114. The shaft 110 is operatively connected to the motor arrangement 40 so that the fingers 100 and 102 can be rotated simultaneously about an axis 118 in response to the rotation of the shaft 110. Additionally, the turret mechanism 108 is mounted to a support plate 120 by way of the collar 112 and fasteners 122. In one example, the support plate 120 is a one inch thick jig plate.

Referring still to FIG. 6, the second finger 102 is pivotally mounted to the turret mechanism 108 so that the second finger 102 can be selectively displaced relative to the first finger 100 to form a gap 124. Displacement is achieved automatically by use of a finger displacement mechanism 126. The finger displacement mechanism 126 includes a movable displacement member 128, the movable displacement member 128 being responsive to the displacement of a "pancake" air cylinder 130.

Referring again to FIG. 5, the third finger 104 is connected to a block 136, the block 136 being slideable mounted on a guide 138. The follower support 138 is operatively connected to the support plate 120. The slideable block 136 is urged away from the fingers 100 and 102 by an arrangement including a cable 140 and a counterweight 142. One end of the cable 140 is integrally connected to the slideable block 136 and the other end to the counterweight 142. The cable rides over a pulley 144 and the counterweight 142 is displaced within a channel 146. A plunger 148 is mounted to and extends from the block 136, so that the plunger 148 interacts cooperatively with an adjustable deceleration damper 150 to set the finger 104 at an extended position with respect to the fingers 100 and 102.

The third finger can be positioned proximate to the second finger 102 by employment of the finger biasing mechanism 154. The biasing mechanism 154 includes a ratchet member 156 defining a set of integral teeth. The teeth cooperate with a latch 160, the movement of the latch 160 being controlled selectively by a solenoid 162. In a first state the solenoid 162 allows the latch 160 to drop into the teeth to hold the finger 104 proximate to the second finger 102, while in a second state, the latch 160 is released so that the third finger 104 is urged, by the sliding block 136, toward the deceleration damper 150. When the plunger 148 engages the damper 150, the third finger 104 is disposed in the extended position. As can be appreciated by reference to FIG. 5, if the belt 10 is positioned about the fingers 102 and 104, the belt 10 will be disposed in an extended position when the third finger 104 is disposed correspondingly in the extended position.

In the preferred embodiment, protective paper is fed into the gap 124 by the protective protective paper feed assembly 18. The feeding assembly 18 includes a protective paper supply 164 and a protective paper transport mechanism 166. The paper supply 164 includes a shaft 168, the shaft 168 being mounted to the support plate 120 and adapted to support a supply or roll 170 of protective paper. In one example, the protective paper is black photo wrap and has a width at least as great as the width of the photoreceptive belt 10 to be wrapped. The transport mechanism 166 includes idler or tension rollers 174 that serve to guide the protective paper to a "dancer" roller mechanism 178. Essentially, the mechanism 178 allows substantial lengths of protective paper to be pulled off of the roll 170 so that inertia of the roll 170 will not impair the wrapping process.

The dancer roller mechanism 178 includes a carriage 180 having a roller 182 mounted thereto. The carriage 180 is positioned on a guide 184, and is responsive to a "rodless cylinder" arrangement 186 manufactured by Festo Corporation of Hauppauge, N.Y. The rodless cylinder arrangement 186 comprises a saddle 188, which saddle 188 is coupled with the carriage 180. The saddle 188 is slideable mounted on a rod 190, and moves in response to an air-driven magnetic piston (not shown) disposed in the rod 190. In the illustrated embodiment the extent of movement of the saddle 188 can be sensed by way of limit switches 194. A description of the rodless cylinder arrangement 186 can be found in U.S. Pat. No. 4,878,985, the disclosure of which is incorporated herein by reference. As will be appreciated by those skilled in the art, any suitable drive mechanism capable of reciprocating the carriage 180 may be used in place of the magnetic reciprocating drive system 186. Moreover, it will also be appreciated that the rodless cylinder arrangement 186 is very similar, in concept, to the drive arrangement 63.

With continuing reference to FIG. 5, the protective paper is pulled through the dancer mechanism 178 by way a nip roller mechanism 196. An idler 198 aids in guiding the protective paper to the mechanism 196. The mechanism 196 includes a nip roller 202 in selective contact with a drive roller 204 to define a nip 206. The drive roller 204 is driven by the motor arrangement 40. The nip roller 202 is operatively connected to a pivotable arm 208, the pivotable arm 208 being in contact with a pancake cylinder 212. When the cylinder 212 is energized, the nip roller 202 is displaced relative to the drive roller 204 so that the nip 206 is disengaged. An encoder 214, of any suitable construction, is operatively associated with the nip roller mechanism 196, and is positioned adjacent the path of the protective paper. As is known, the encoder 214, in conjunction with the controller 44, is capable of determining the length of protective paper that passes by the mechanism 196 in a predetermined time period. Accordingly, under ideal operation, the controller 44 is informed as to the moment that the leading edge of the protective paper passes through the gap 124.

The protective paper is directed from the exit of mechanism 196, to the gap 124, by way a paper guide network 216, the guide network 216 including an adjustable guide 218 as well as a fixed set of baffles 220 and a movable set of baffles 222. The leading edge of the protective paper is further directed into the gap 124 by means of guide cylinders 224. Each of guide cylinders 224 has a guide needle 226, the displacement of which is effected by the controller 44.

While, under ideal operating conditions, the encoder 214 can be employed to detect when the leading edge of the protective paper has passed through the gap 124, the encoder 214 cannot accurately accomplish this detection on a regular basis. For example, even when the protective paper "strays" from the network 214, the encoder 214 will indicate that the leading edge is through the gap 124 since the encoder 214 merely detects the length of protective paper that has passed by. To verify information from the encoder 214, a secondary detection system, namely a photodetecting arrangement, is provided.

As illustrated in FIG. 5, a light transmitting/photodetecting unit 228, which communicates with the controller 44, is mounted on the support plate 120 at a location spaced from the gap 124. A reflector 229 is positioned proximate to the gap 124 so that light transmitted from the unit 228 can be reflected back to a photoreceptive device (not shown) disposed in the unit 228. When the light beam is broken by the leading edge of the protective paper passing through the gap 124, the corresponding signal can be transmitted to the controller 44, via the transmitting/photo-detecting unit 228, to indicate the presence of the protective paper. In one example, an upper portion of the movable baffles 222 is mounted to a cutting mechanism 230. Both of the nip roller mechanism 196 and the cutting mechanism 230 are mounted to the support plate 120 by way of a back plate 232. In particular, the cutting mechanism 230 includes a frame 234 having a slide-piece 236, while the back plate 232 has a guide 238 for receiving the slide-piece 236. The slide-piece 236, and hence the frame 234, can be displaced along the guide 238 by an arrangement including a pulley 240 and a cable 242. The slide-piece 236 responds to the rotation of the pulley 240, and the slide-piece 236 is positioned selectively by a manual clamp 244. The manual clamp 244 is slideable mounted in a slot (not shown), the slot being defined in a side wall 246 of the back plate 232.

The cutting mechanism 230 further includes a cutting device 250 having a rotary cutting blade 252. As illustrated in FIG. 5, the blade 252 is disposed transverse to the long axis of the protective paper. The cutting device 250 is operatively mounted to a drive mechanism 254, and the drive mechanism 254 is mounted to the frame 234. The drive mechanism 254 can be any suitable drive, such as the rodless cylinder arrangement 186. As with rodless cylinder arrangement 186, the drive mechanism 254 could include a movable saddle 256, the displacement of which could be constrained by limit switches (not shown). In its home position, the cutting device 250 is retracted so that the paper is spaced from the rotary cutting blade 252. When cutting of the protective paper is desired, the saddle 256 is displaced from the home position so that the cutting blade 252 is driven through a path that permits the cutting device 250 to cut a sheet of protective paper. Since the frame 234 is adjustable, the cutting mechanism 230 is adapted to cut sheets of varying length.

A tailing assembly, the significance of which will be described in further detail below, comprises a half-tailer 260 and a full-tailer 262. The half-tailer 260 includes a carriage 261 slideable mounted on a drive mechanism 264, the drive mechanism 264 being operatively mounted to the support plate 120. The drive mechanism 264 can comprise any suitable mechanism, such as a rodless cylinder arrangement. In the illustrated embodiment, the carriage 261 is driven along a guide 266 by a rodless cylinder device 268. The half-tailer 260 further includes a keeper 272, which keeper 272 can be displaced pivotally for height adjustment by a keeper displacement mechanism 274. The mechanism 274 comprises an arm 276, the arm 276 being pivotally connected to a pancake air cylinder 278 by way of a link 280. The extent to which the arm 276 is displaced can be sensed by way of the limit switches (not shown). When the cylinder 278 is activated, the arm 276 is pivoted to raise the keeper 272 by a predetermined distance.

The full-tailer 262, which includes an air cylinder 284 operatively connected to an air rotary cylinder 286, is mounted operatively to the support plate 120. The full-tailer 262 also includes a wiper 288, which wiper 288 rotates in response to the rotation of the rotary cylinder 286. The air cylinder 284 is capable of raising the wiper 288 to a location adjacent the cores 30, so that the wiper 288 can be positioned proximate to preselected portions of the cores 30 when the wiper 288 is rotated through a predetermined arc.

Figure 7:
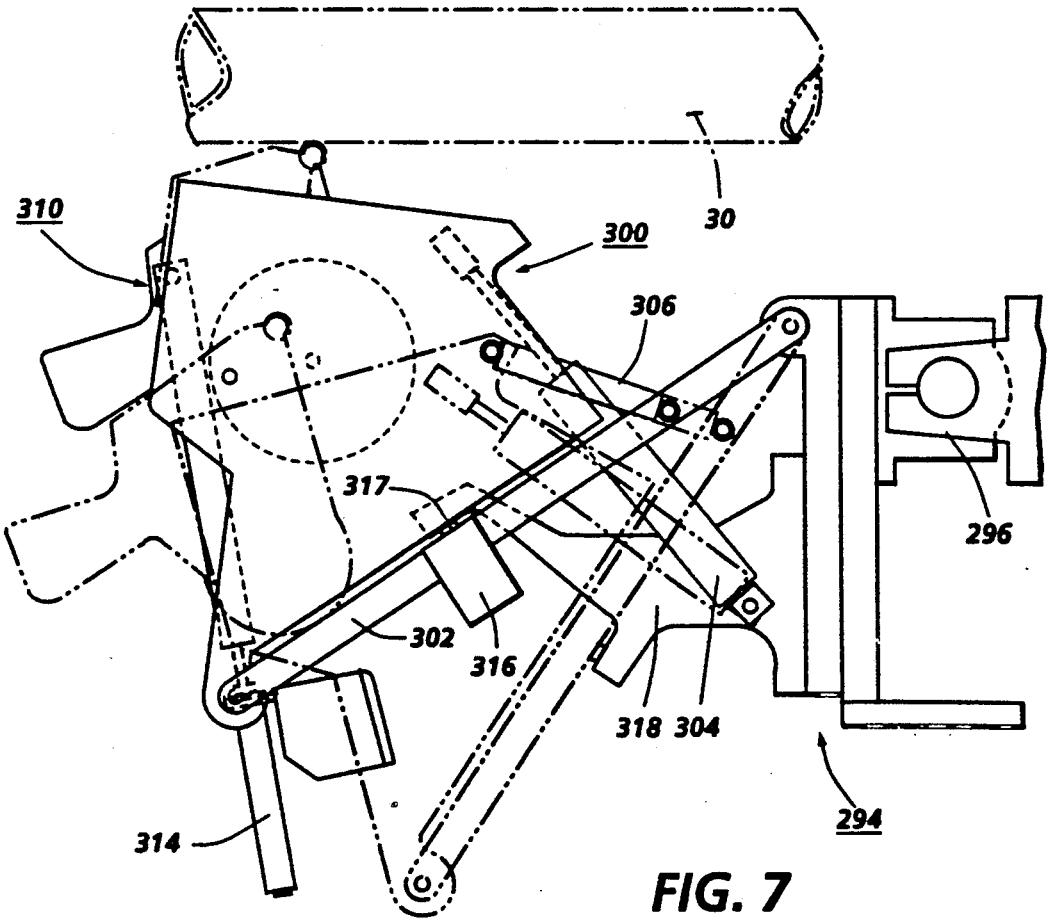
FIG. 7 is a side view of a taping assembly schematically illustrated in FIG. 5.

Referring to FIGS. 5 and 7, a taping assembly is designated by the numeral 292. The taping assembly 292 includes a carriage 294 (FIG. 5), which carriage 294 can be displaced along a guide 296. The carriage 294 is reciprocated, relative to a home position, by an air cylinder 298. In the preferred embodiment, the guide 296 and the air cylinder 298 are mounted to the support plate 120. A taper 300 (FIG. 7) is pivotally mounted to the carriage 294 with a swivel arm 302, and the taper 300 is driven upward by an air cylinder 304. In one example, the taper 300 is a conventional label "gun" of the type used in supermarkets for applying labels to inventory. As the taper 300 is driven upward by the air cylinder 304, a spring or air cylinder 306, interposed between the taper 300 and the swivel arm 302, is activated so that the taper 300 is directed through a semicircular path. This is essentially the same path or wiping motion that would be employed in placing labels on supermarket inventory.

Referring specifically to FIG. 7, the taper 300 includes a trigger 310 which, upon activation, allows tape to be dispensed from a roll of conventional tape (not shown) disposed within the taper 300. The trigger 310 is "pulled" by an air cylinder 314, which air cylinder 314 communicates selectively with an air source (not shown) by way of a valve 316. In particular, the valve 316 has an actuating button 317, and the valve 316 is mounted to the swivel arm 302. Additionally, a bracket 318 mounted to the carriage 294 is disposed in the semicircular path of the swivel arm 302. As the taper 300 is reciprocated through the semicircular path, the button 317 is depressed by an end portion of the bracket 318 so that the valve 316 is opened and the trigger 310 is pulled.

Referring again to FIGS. 2-3, the preferred form of operation for core loading/core unloading is explained in further detail. Initially, a plurality of cores 30 are loaded into the hopper 26 and a stream of cores 30 is delivered to the top of chute 28 by the conveyor mechanism 32. In their home positions, the needles 60 of the core stop 59 are extended to retain the cores 30, while the needles 60 of the core separator 61 are retracted. To load a preselected number of cores 30, preferably three of cores 30, onto platform 82, the cart 20 is moved proximate the core stop 59 and the air cylinder 72 is then retracted. By use of the controller 44, the needles 60 of the core separator 61 are extended, and the needles 60 of the core stop 59 are retracted, so that three of cores 30 fall onto the platform 82.

Once the cores 30 are on the platform 82, the cart 20 is shuttled over to the fingers 100, 102 and 104 by extending the cylinders 72, 74. In particular, the first cylinder 72 is capable of aligning the cores 30 with the fingers 100, 102 and 104, while the second cylinder 74 is capable of positioning cores 30 on the fingers 100, 102 and 104. After positioning the cores 30 on the fingers 100, 102 and 104, the cart 20 is retracted so that the positioned cores 30 have clearance in which to rotate.

Figure 8A:
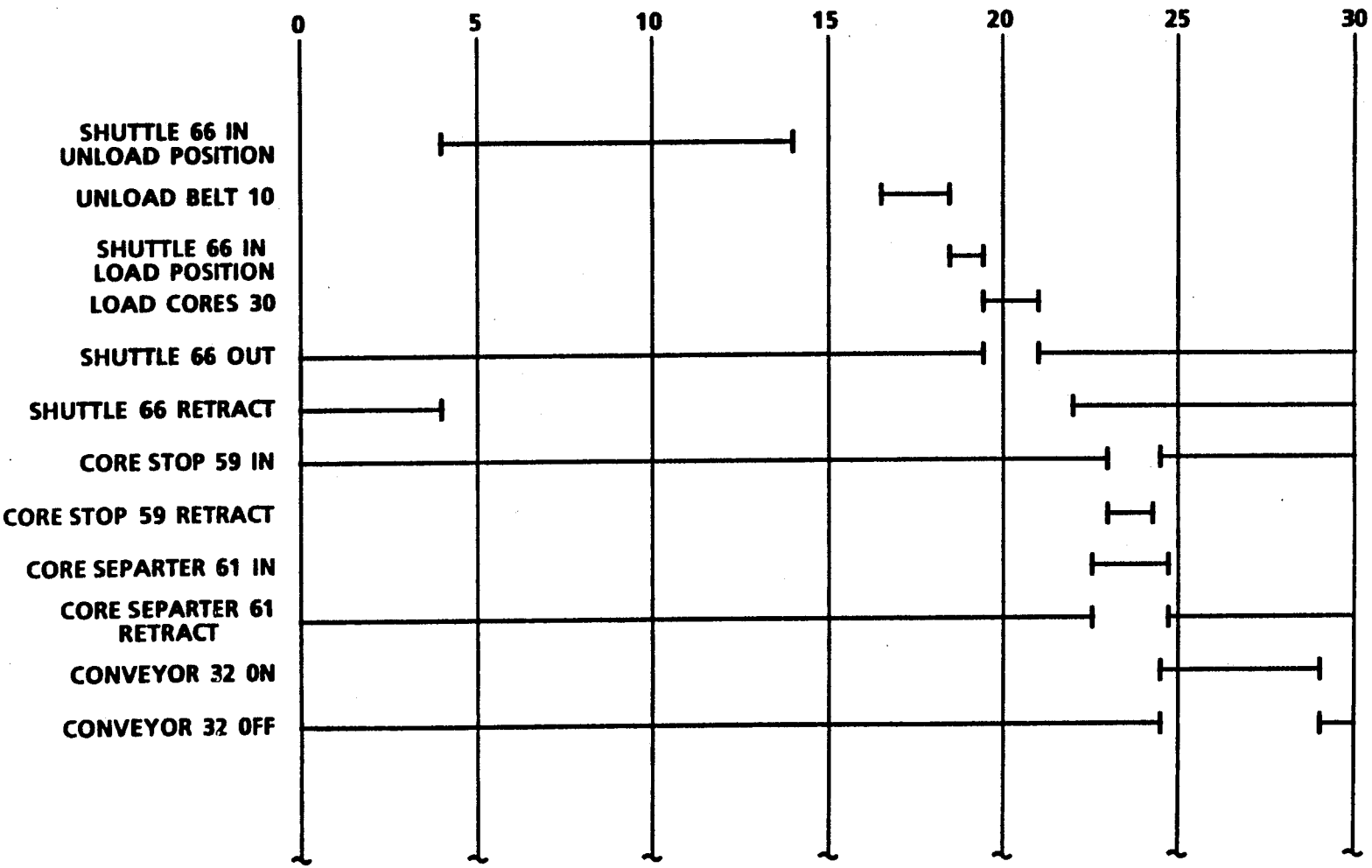
FIGS. 8A-8C are timing diagrams depicting time intervals taken to perform major steps in the belt wrapping process.

Upon initially loading the cores 30 onto the cart 20, the core loading steps can be achieved in accordance with the sequence illustrated in FIG. 8A. For example, before loading three of cores 30 onto the respective fingers 100, 102 and 104, the receiving bin 22 is positioned adjacent the fingers 100, 102 and 104 in an unload position so that a wrapped belt, i.e. a finished product (FIG. 10B), can be unloaded from the wrapping assembly 16 into the bin 22. Upon unloading the finished product the three cores 30 are aligned with the fingers 100, 102 and 104 and the cores 30 are loaded thereon. The cart 20 is then retracted to the exit end of the chute 28 to retrieve three more cores 30, as described above.

Referring now to FIGS. 5-6, 8B and 9A-9E, the operation of the wrapping assembly 16 and the protective paper feed assembly 18 is explained in further detail. Initially, the protective paper is threaded manually through the dancer roller mechanism 178, the nip roller mechanism 196 and the paper guide network 216. The finger displacement mechanism 126 is actuated to form the gap 124, and the leading edge of the protective paper is positioned therein. Upon placing the belt 10 about the fingers 102 and 104, the gap 124 is closed and the solenoid 164 is actuated so that the belt 10 is urged into the extended position by the unlatched block 136. Additionally, the dancer roller mechanism 178 is actuated so that a length of protective paper is pulled down.

Figure 8B:
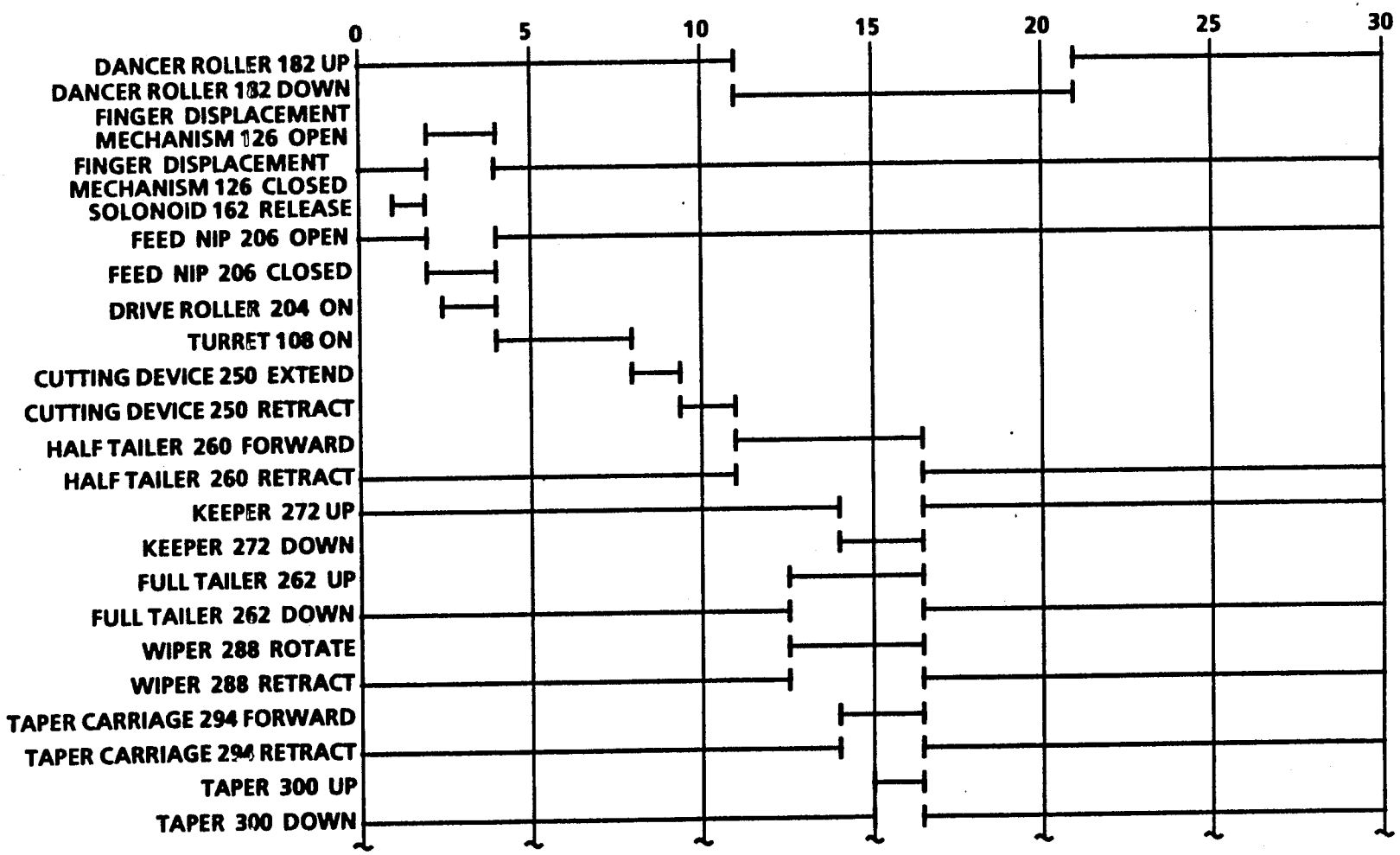
Figure 8C:
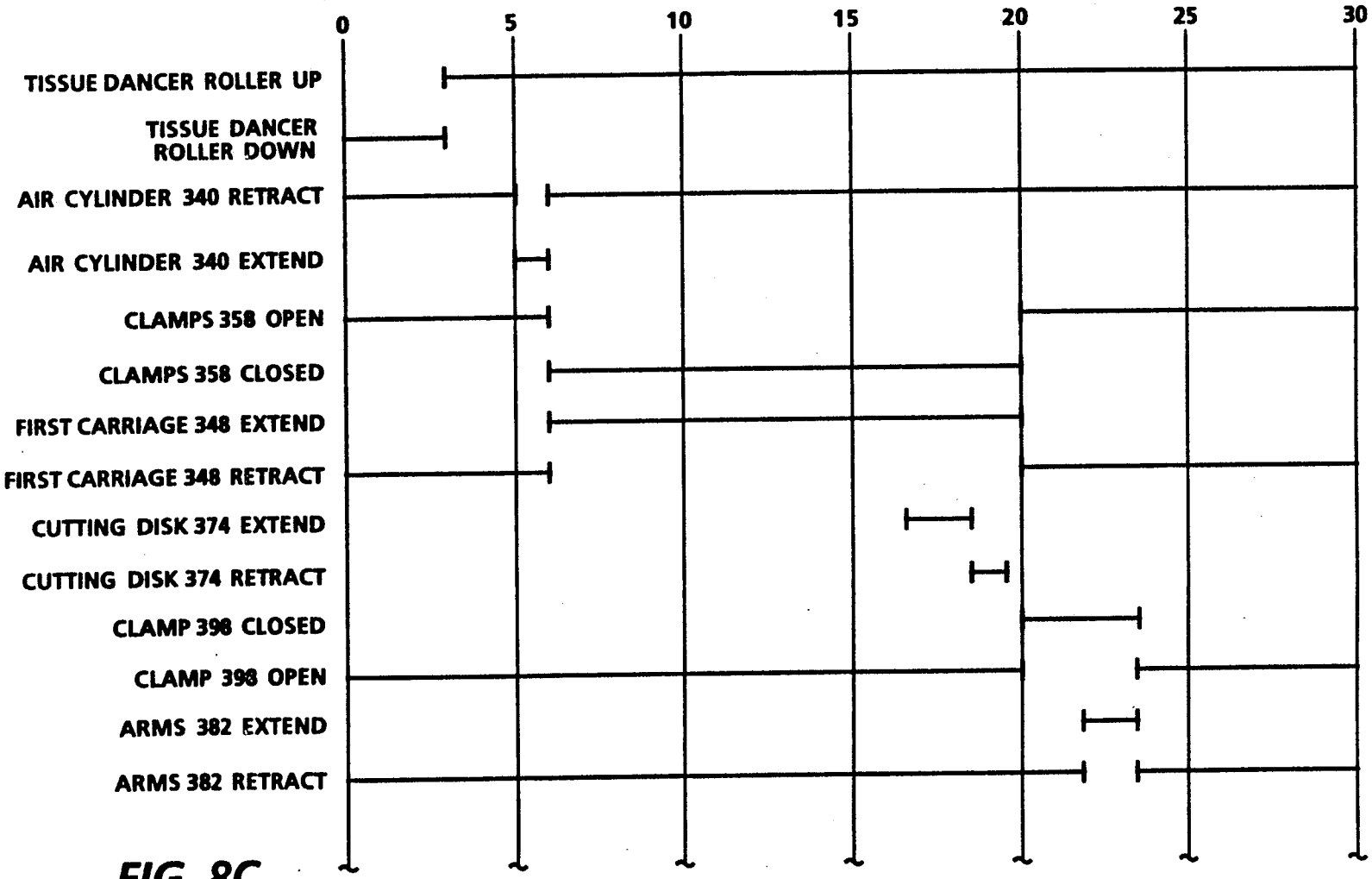

Referring specifically to FIG. 8B, an automatic belt wrapping process is shown. The process outlined in FIG. 8B presupposes that, prior to start up, i.e. "0" seconds on the time scale, the protective paper has already been threaded through the protective paper feed assembly 18, and pulled down by the dancer roller mechanism 178. Consequently, in the scheme of FIG. 8B the dancer roller 182 is not be pulled down until the protective paper has been driven automatically, by way of nip roller mechanism 196 to the gap 124, and a sheet of protective paper has been cut from the protective paper supply.

To wrap the belt 10, the nip 206 is opened (FIGS. 5 and 8B), the guide needles 226 are retracted, and the turret mechanism 108 is rotated about axis 118 in a counter-clockwise direction. Accordingly, the third finger 104 is "reeled in" and the protective paper is wrapped about a substantial potion of the photosensitive surface of the belt 10. When the third finger 104 is proximate the second finger 102 (FIG. 9A), rotation of the turret mechanism 108 is halted and a sheet of protective paper is formed by extending and retracting the cutting device 250 (FIG. 5) across a preselected portion of the protective paper supply.

A tail portion 318 of the protective paper (FIG. 9A) is formed as a result of the cutting step. Referring to both FIGS. 8B and 9B-9C, the carriage 261 of the half-tailer 260 extends from its home position, so that the keeper 272 "knocks down" the tail, and the keeper 272 descends to partially fold the tail over. Referring to both FIGS. 8B and 9D, as the half tailer 260 is extended, the full tailer 262 is moved up to a point just under a plane in which the fingers 100, 102 and 104 are disposed, and the wiper 288 is rotated so that the trailing edge of the sheet of protective paper is retained against a portion of the protective paper that has already been wrapped about the cores 30.

Figure 9A:
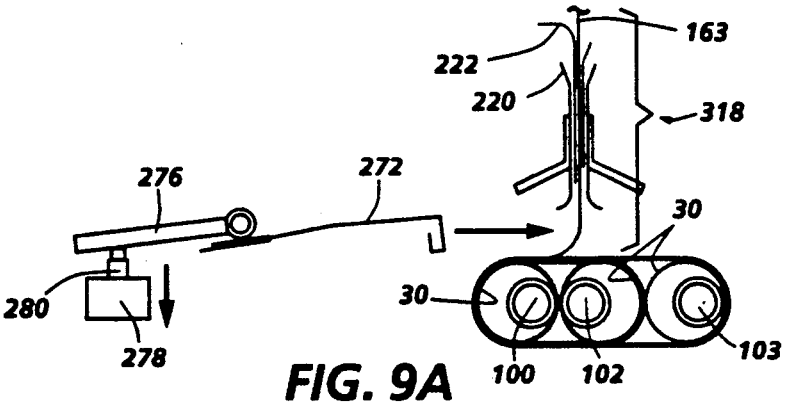
FIGS. 9A-9E are schematic, fragmentary, elevational views of the apparatus depicting a process employed to wrap a tail portion of a sheet of protective paper about three cores.
Figure 9B:
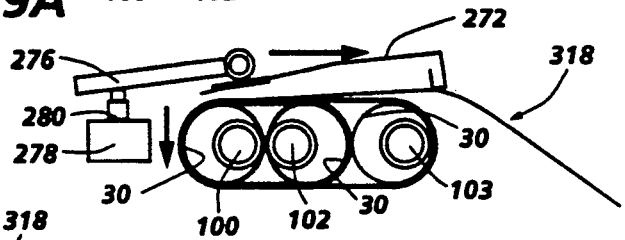
Figure 9C:
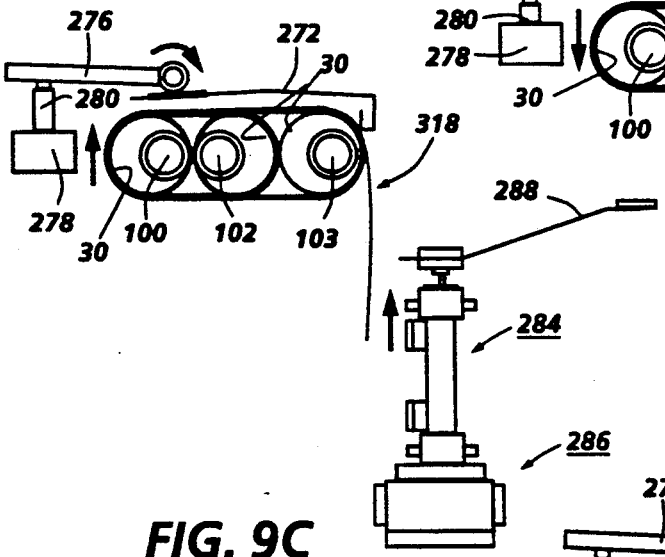
Figure 9D:
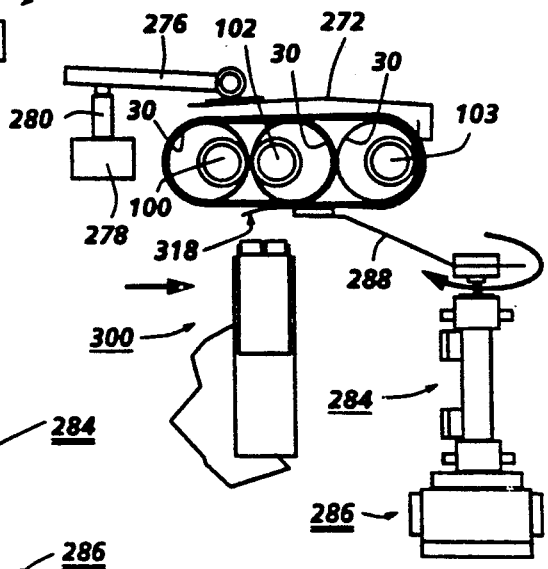
Figure 9E:
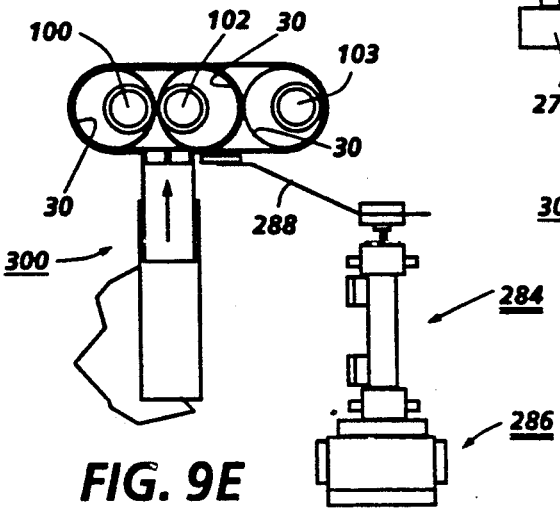
Figures 10A, 10B:
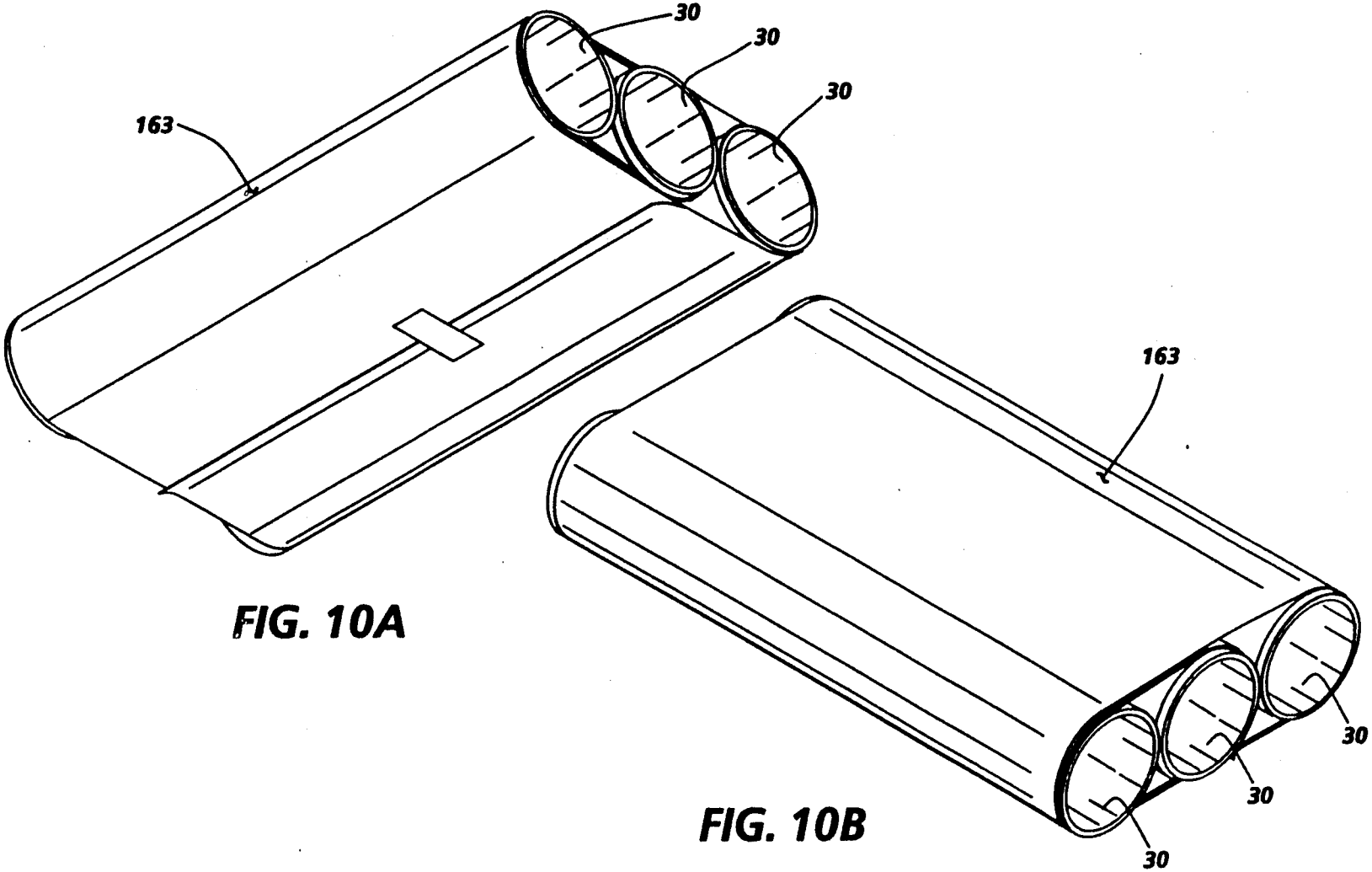
FIGS. 10A-10B are perspective views of a photoreceptive belt wrapped about the three cores by the apparatus.

Referring to FIGS. 7, 8B and 9E, shortly after the wiper 288 begins to rotate, the taping assembly carriage 294 is moved to a point under the cores 30 by air cylinder 298. Air cylinders 304 and 306 are activated in sequence so that the taper 300 is moved upward through a semicircular path. As the taper 300 wipes against the protective paper, the valve 316 is opened, and the trigger 310 is pulled accordingly by the air cylinder 314. As illustrated in FIG. 10A, a piece of tape is thereby applied to the finished product so that the trailing edge of the protective paper is secured against the protective paper already wrapped around the cores 30. As will be appreciated by those skilled in the art, other means besides a taper, such as a gluing device, could be used to secure the trailing edge. After the taping step is completed, the wrapped belt 10 (FIG. 10B) can be either manually or automatically unloaded, and deposited in receiving bin 22. A technique for automatic unloading is discussed in copending patent application Ser. No. 07/724,307, entitled "Apparatus for Handling a Sheet of Separator Material," filed Jul. 1, 1992, the relevant portions of which are incorporated herein by reference.

What is claimed is:

1. An apparatus for wrapping a sheet about an external surface of a flexible member to package the flexible member, comprising:

means for receiving and clamping a free end of the sheet and a first portion of the flexible member, said receiving and clamping means including first and second fingers and means for selectively displacing said fingers relative to one another for forming a gap between said first and second fingers to receive the free end of the sheet and the first portion of the flexible member therein and for closing the gap to clamp the free end of the sheet and the first portion of the flexible member substantially simultaneously;

means for spacing a second portion of the flexible member a preselected distance from the first portion thereof; and means for moving said receiving and clamping means to urge said spacing means toward said receiving and clamping means so that movement of said receiving and clamping means wraps the flexible member and sheet with the sheet being wrapped about the external surface of the flexible member wherein the clamping of the free end of the sheet and the first portion of the flexible member is initiated prior to the movement of said moving means.

2. The apparatus of claim 1, wherein the flexible member comprises an elongate flexible loop.

3. The apparatus of claim 2, wherein the elongate flexible loop is a photoreceptor belt.

4. The apparatus of claim 1, wherein said receiving and clamping means includes means for supporting portions of the flexible member, wherein the flexible member comprises an elongate flexible loop, and wherein said supporting means comprises at least one finger and a core member, said finger being adapted to both receive and position said core member, said core member being adapted to support an internal portion of the elongate flexible loop.

5. The apparatus of claim 4, wherein the core member defines a hollow cavity, and wherein the transverse cross-sectional area of said finger is substantially less than the transverse cross-sectional area of the hollow cavity.

6. The apparatus of claim 1, wherein:

said selectively displacing means comprises an air cylinder disposed in said first finger and a displacement member interconnecting said air cylinder and said second finger; and when said air cylinder is activated, said second finger is displaced away from said first finger by said displacement member.

7. The apparatus of claim 1, wherein said spacing means comprises means for urging said spacing means away from said receiving and clamping means after the first and second portions of the flexible member have been respectively positioned about said receiving and clamping means and said spacing means.

8. The apparatus of claim 7, wherein the flexible member comprises an elongate flexible loop, wherein said receiving and clamping means includes means for supporting portions of the flexible member, wherein said supporting means includes a core member adapted to support an internal portion of the elongate flexible loop, wherein said spacing means includes a finger adapted to receive and position said core member, and wherein said urging means comprises:

an urging member connected to said finger;

means for guiding said urging member, said urging member being movably coupled to said guide means; and means for forcibly driving said urging member along said guide means.

9. The apparatus of claim 8, wherein said urging means includes means for damping the movement of said urging member after said urging member has moved a predetermined distance from said receiving and clamping means.

10. The apparatus of claim 1, further comprising means for selectively biasing said spacing means adjacent said receiving and clamping means.

11. The apparatus of claim 1, wherein said receiving and clamping means comprises a turret member supporting said first and second fingers, and wherein said moving means includes turret rotating means, coupled to said turret member, for rotating said turret member so that rotation of said turret rotating means causes said first and second fingers to be rotated simultaneously about a common axis.

12. The apparatus of claim 1, wherein:

the sheet includes a main body and a tail portion;

the tail portion is disposed immediately adjacent the main body when the sheet is substantially wrapped about the flexible member; and said apparatus further comprises means for securing the tail portion to the main body.

13. The apparatus of claim 12, wherein said securing means comprises an automatic tape dispensing device, said taping device being adapted for movement from a home position to a taping position.

14. The apparatus of claim 1, wherein the sheet includes a main body and a tail portion, and wherein said apparatus further comprises:

means for folding the tail portion from an unwrapped position to a wrapped position so that the tail portion is disposed immediately adjacent the main body of the sheet.

15. The apparatus of claim 14, wherein the means for folding comprises:

means for partially folding the tail portion so that the tail portion is disposed in a position intermediate the unwrapped position and the wrapped position; and means for urging the tail portion from the intermediate position to the wrapped position.

16. The apparatus of claim 1, in which the flexible member comprises an elongate flexible loop, said apparatus further comprising:

core members being adapted to be disposed within the elongate flexible loop for supporting internal portions of the elongate flexible loop; and means for transporting automatically said core members to both of said receiving and clamping means and said spacing means, said receiving and clamping means and said spacing means being adapted to receive said core members.

17. The apparatus of claim 16, wherein said transport means comprises:

a transport member adapted to retain said core members thereon;

means for selectively loading said core members on said transport member; and means for moving said transport member between said selective loading means and both of said receiving and clamping means and said spacing means.

18. The apparatus of claim 1, wherein said receiving and clamping means defines a gap adapted to receive the free edge of the sheet, and wherein said apparatus further comprises means for advancing the free edge into said gap.

19. The apparatus of claim 17, further comprising means for determining when the free edge has passed through the gap.

20. The apparatus of claim 1, wherein the sheet is made from black photo-wrap.

* * * * *